US009347162B1

(12) United States Patent
Pitts

(10) Patent No.: US 9,347,162 B1
(45) Date of Patent: May 24, 2016

(54) FABRIC SEAM ALIGNMENT TOOL

(71) Applicant: Ronald R. Pitts, Clearwater, FL (US)

(72) Inventor: Ronald R. Pitts, Clearwater, FL (US)

( * ) Notice: Subject to any disclaimer, the term of this patent is extended or adjusted under 35 U.S.C. 154(b) by 148 days.

(21) Appl. No.: 14/086,333

(22) Filed: Nov. 21, 2013

(51) Int. Cl.
*B25B 3/00* (2006.01)
*D05B 35/04* (2006.01)

(52) U.S. Cl.
CPC ..... *D05B 35/04* (2013.01)

(58) Field of Classification Search
CPC ..... D05B 34/04; D05B 91/06; D05B 35/02; B25B 5/04
See application file for complete search history.

(56) References Cited

U.S. PATENT DOCUMENTS

| | | | | | |
|---|---|---|---|---|---|
| 4,175,306 | A * | 11/1979 | Bigelow et al. | 24/507 |
| 5,052,085 | A * | 10/1991 | Gau | 24/501 |
| 5,318,292 | A * | 6/1994 | De Marco | 24/3.11 |
| 5,350,092 | A * | 9/1994 | Hollis | 223/96 |
| 5,546,640 | A * | 8/1996 | Kronauer et al. | 24/510 |
| 6,557,441 | B1 * | 5/2003 | Brihier | 81/119 |
| 6,754,937 | B1 * | 6/2004 | Martin | 24/351 |
| 2003/0188403 | A1 * | 10/2003 | Lemke et al. | 24/338 |
| 2010/0078864 | A1 * | 4/2010 | Lancaster-Larocque | 269/8 |

* cited by examiner

*Primary Examiner* — Monica Carter
*Assistant Examiner* — Nirvana Deonauth

(57) ABSTRACT

A fabric seam alignment tool has an upper plate and a lower plate. Each plate has interior and exterior surfaces, parallel side edges, and forward and rearward ends. A swivel plate couples the upper and lower plates. A central plane is created through the tool midway between the upper and lower plates. A forward opening is located between the upper and lower plates forwardly of the swivel plate. A rearward opening is between the upper and lower plates rearwardly of the swivel plate. The tool is formed of a transparent plastic having limited resilience.

5 Claims, 2 Drawing Sheets

FABRIC SEAM ALIGNMENT TOOL

BACKGROUND OF THE INVENTION

Field of the Invention

The present invention relates to a fabric seam alignment tool and more particularly pertains to assisting a user to align two sections of pieced fabric, each fabric section having an angled seam line and pattern points, then when the two sections are sewn together, the angled seams meet properly on pattern point at the sewn seam line, the aligning, pinning, sewing and meeting being done in a safe, accurate, convenient and economical manner.

SUMMARY OF THE INVENTION

In view of the disadvantages inherent in the known types of fabric tools of known designs and configurations now present in the prior art, the present invention provides an improved fabric seam alignment tool. As such, the general purpose of the present invention, which will be described subsequently in greater detail, is to provide a new and improved fabric seam alignment tool and method which has all the advantages of the prior art and none of the disadvantages.

To attain this, the present invention essentially comprises an upper plate and a lower plate. Each plate has interior and exterior surfaces. Each plate has parallel side edges. Each plate further has forward and a rearward ends.

A swivel plate is provided. The swivel plate couples the upper and lower plates. A central plane is created. The central plane is located through the tool midway between the upper and lower plates. A forward opening is provided. The forward opening is located between the upper and lower plates. The forward opening is provided forwardly of the swivel plate. A rearward opening is provided. The rearward opening is provided between the upper and lower plates. The rearward opening is provided rearwardly of the swivel plate. The tool is formed of a transparent plastic. The transparent plastic has limited resilience.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fabric seam alignment tool which has all of the advantages of the prior art fabric tools of known designs and configurations and none of the disadvantages.

It is another object of the present invention to provide a new and improved fabric seam alignment tool which may be easily and efficiently manufactured and marketed.

It is further object of the present invention to provide a new and improved fabric seam alignment tool which is of durable and reliable construction.

An even further object of the present invention is to provide a new and improved fabric seam alignment tool which is susceptible of a low cost of manufacture with regard to both materials and labor, and which accordingly is then susceptible of low prices of sale to the consuming public, thereby making such fabric seam alignment tool economically available to the buying public.

Lastly, another object of the present invention is to provide a fabric seam alignment tool for assisting a user to align two sections of pieced fabric, each fabric section having an angled seam line and pattern points, then when the two sections are sewn together, the angled seams meet properly on pattern point at the sewn seam line, the aligning, pinning, sewing and meeting being done in a safe, accurate, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
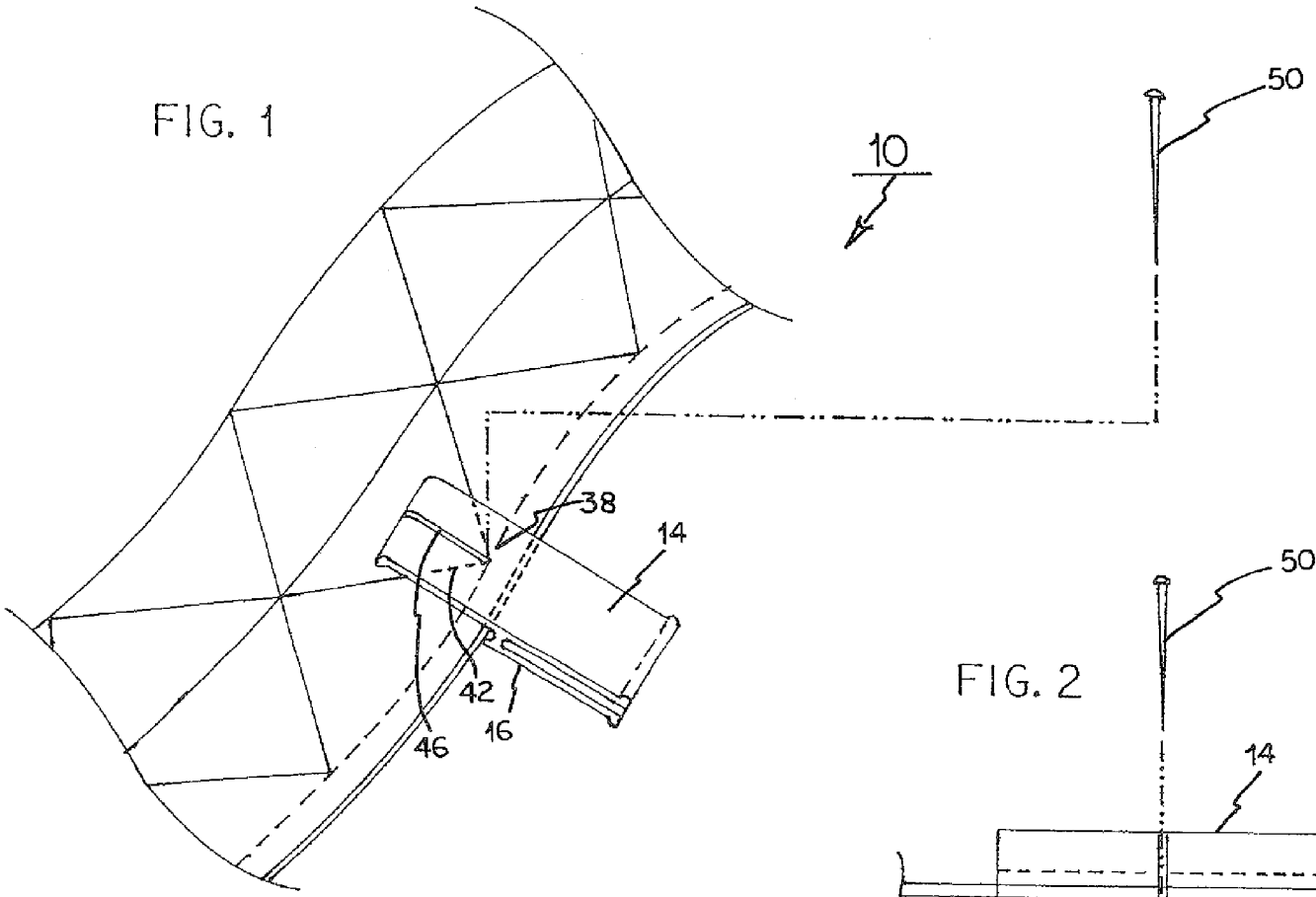
FIG. 1 is a perspective illustration of a fabric seam alignment tool constructed in accordance with the principles of the present invention.
Figure 2:
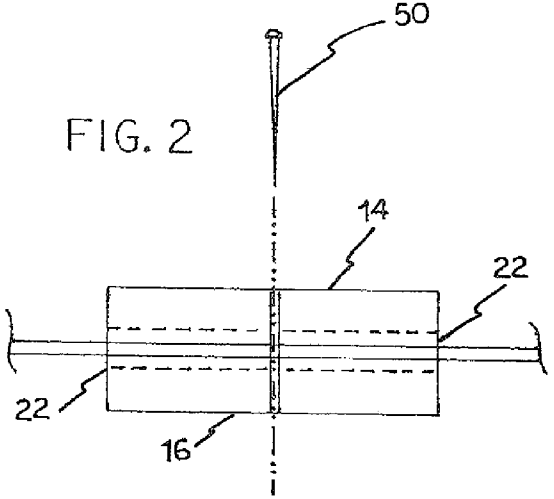
FIG. 2 is a front elevational view of the system illustrated in FIG. 1.
Figure 4:
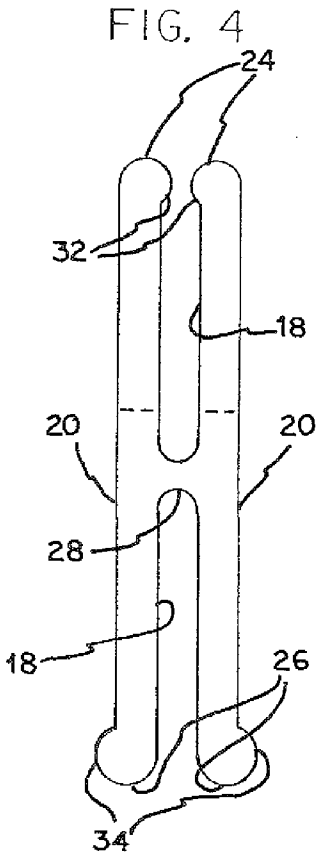
FIG. 4 is a side elevational view of the system illustrated in the prior Figures.
Figure 3:
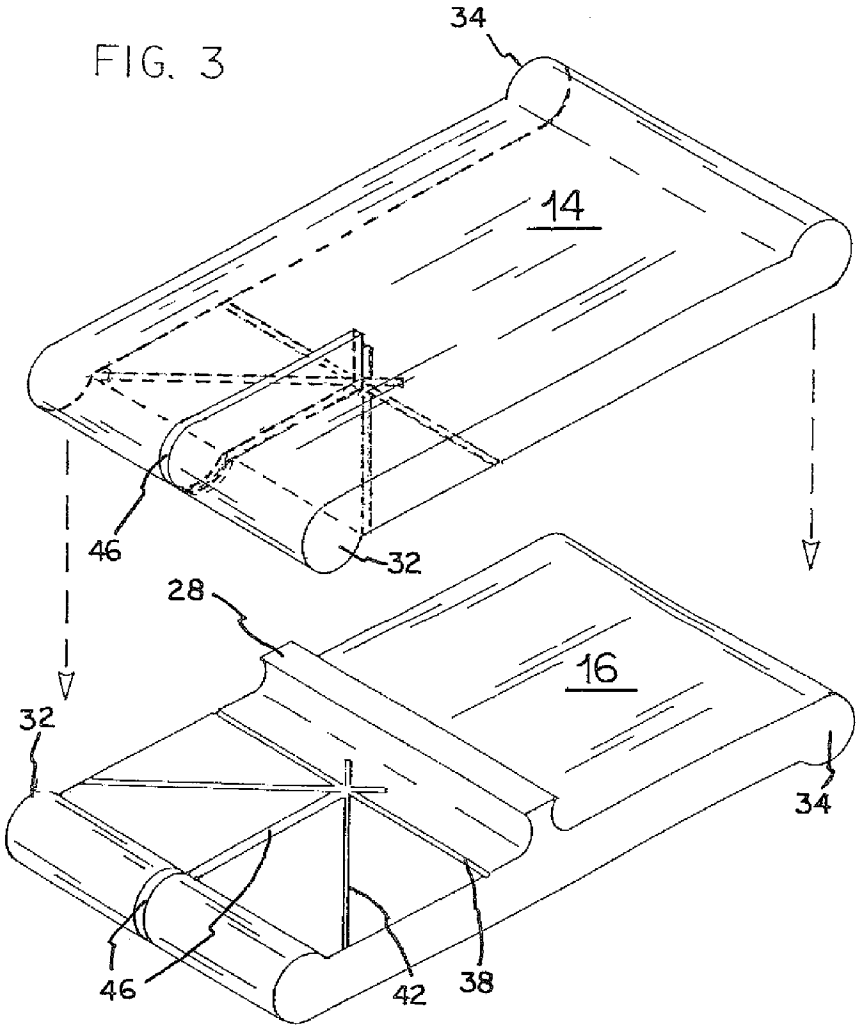
FIG. 3 is an exploded perspective of the system of the prior Figures.

With reference now to the drawings, and in particular to FIG. 1 thereof, the preferred embodiment of the new and improved fabric seam alignment tool embodying the principles and concepts of the present invention and generally designated by the reference numeral 10 will be described.

The present invention, the fabric seam alignment tool 10 is comprised of a plurality of components. Such components in their broadest context include an upper plate, a lower plate, and a swivel plate. Such components are individually configured and correlated with respect to each other so as to attain the desired objective.

First provided is an upper plate 14. Also provided is a similarly configured lower plate 16. Each plate has an interior surface 18. Each plate has an exterior surface 20. The tool has a height. The upper and lower plates each have a central thickness. The upper and lower plates each have parallel side edges 22. The side edges are separated by a width. The upper and lower plates each have a forward end 24. The upper and lower plates each have a rearward end 26. The forward and rearward ends are separated by a length.

A swivel plate 28 is provided. The swivel plate has a height. The swivel plate has a thickness. The swivel plate couples the upper and lower plates. The swivel plate extends from side edge to side edge of the upper and lower plates. The swivel plate extends from a location midway between the forward end and rearward end of the upper and lower plates. A central plane is created. The central plane is located through the tool. The central plane is provided midway between the upper plate and the lower plate. The central plane is provided parallel with the upper and lower plates. A forward opening is provided. The forward opening is provided between the upper and lower plates. The forward opening is provided forwardly of the swivel plate. A rearward opening is provided. The rearward opening is provided between the upper and lower plates. The rearward opening is provided rearwardly of the swivel plate. The tool is integrally formed of a transparent plastic. The transparent plastic has limited resilience. In this manner squeezing together the rearward ends of the upper and lower plates will spread apart the forward ends of the upper and lower plates. Also in this manner the sections of fabric to be aligned are received. Further in this manner releasing the rearward ends of the upper and lower plates will resile the forward ends of the upper and lower plates. Also in this manner the sections of fabric are secured.

Interiorly extending enlargements 32 are provided. The interiorly extending enlargements are formed in the upper and lower plates. The interiorly extending enlargements are provided adjacent to the forward ends of the upper and lower plates. In this manner the height between the upper and lower plates is reduced. Further in this manner coupling of the tool to the sections of fabric is facilitated. Exteriorly extending enlargements 34 are provided. The exteriorly extending enlargements are formed in the upper and lower plates. The exteriorly extending enlargements are provided adjacent to the rearward ends of the upper and lower plates. In this manner the squeezing of the rearward ends of the upper and lower plates and increases the distance between the between the upper and lower plates at the forward ends.

Also provided is a seam allowance registration mark 38. The seam allowance registration mark is formed in the interior surface of both the upper and lower plates. The allowance registration mark is provided parallel with the forward end. The seam allowance registration mark is provided forwardly of the swivel plate. The seam allowance registration mark has a midpoint equally spaced from the side edges.

Provided next are matching alignment marks 42. The matching alignment marks are in a V-shaped configuration. The matching alignment marks have an apex of 90 degrees at the midpoint of the seam allowance registration marks. Note is taken that the V-shaped alignment marks are illustrated as being 90 degrees. It should be understood that such marks may be at any of a plurality of angles as a function of the pattern being assembled. It is further noted that in use, a user may employ a plurality of tools, several tools at one angle and several tools at various other angles.

The registration mark and all of the alignment marks are in the interior surfaces of both plates. Further, the marks of the upper plate are in alignment with the marks of the lower plate.

Further provided is a pin clearance slot 46. The pin clearance slot extends through the upper and lower plates. The pin clearance slot extends from the forward end to a location adjacent to the midpoint of the seam allowance registration mark and the apex of the matching alignment marks.

Provided last is a pin 50. It should be understood that neither the pin nor the fabric is considered to be part of the tool.

In the preferred embodiment, the tool has a length of 2.0 inches, plus or minus 20 percent; a height of 0.375 inches, plus or minus 20 percent; and a width of 0.75 inches, plus or minus 20 percent. The upper and lower plates have a thickness of 0.125 inches, plus or minus 20 percent. The swivel late has a thickness of 0.125 inches, plus or minus 20 percent. The seam allowance registration mark is 0.25 inches forward from the swivel plate.

The pin extends through the pin clearance slot remote from the forward end with the fabric within the interior opening of the tool. The pin also extends through the seam of the fabric section and through the seam allowance registration mark. The pin further extends through a pattern point of the fabric section and the apex of the matching alignment marks.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fabric seam alignment tool (10) comprising;

an upper plate (14) and a lower plate (16), each plate having an interior surface (18) and an exterior surface (20), each plate having parallel side edges (22), each plate having a forward end (24) and a rearward end (26);

a swivel plate (28) coupling the upper and lower plates, a central plane located through the tool midway between the upper and lower plates, a forward opening between the upper and lower plates forwardly of the swivel plate, a rearward opening between the upper and lower plates rearwardly of the swivel plate, the tool being formed of a transparent material with limited resilience;

a seam allowance registration mark (38) formed in the interior surface of the upper and lower plates parallel with the forward end, the seam allowance registration mark being forwardly of the swivel plate, the seam allowance registration mark having a midpoint equally spaced from the side edges; and matching alignment marks (42) in a V-shaped configuration, the matching alignment marks forming an angle common to both the upper and lower plates, the angle having an apex at the midpoint of the seam allowance registration mark.

2. The tool as set forth in claim 1 and further including:

interiorly extending enlargements (32) formed in the upper and lower plates adjacent to the forward ends of the upper and lower plates to reduce the height between the upper and lower plates to facilitate the coupling of the tool to sections of fabric; and exteriorly extending enlargements (34) formed in the upper and lower plates adjacent to the rearward ends of the upper and lower plates to facilitate the squeezing together of the rearward ends of the upper and lower plates with attendant increasing of the distance between the upper and lower plates at the forward ends.

3. The tool as set forth in claim claim 1 and further including:

a pin clearance slot (46) extending through the upper and lower plates from the forward end to a location adjacent to the midpoint of the seam allowance registration mark and the apex of the matching alignment marks.

4. A fabric seam alignment tool (10) for assisting a user in aligning two sections of pieced fabric, each fabric section having an angled seam line and pattern points, then when the two sections are sewn together, the angled seams meet properly on pattern point at the sewn seam line, the aligning, pinning, sewing and meeting being done in a safe, accurate, convenient and economical manner, the system comprising, in combination:

an upper plate (14) and a similarly configured lower plate (16), each plate having an interior surface (18) and exterior surface (20), the tool having a height, the upper and lower plates each having a central thickness, the upper and lower plates each having parallel side edges (22) separated by a width, the upper and lower plates each having a forward end (24) and a rearward end (26) separated by a length;

a swivel plate (28) having a height, the swivel plate having a thickness, the swivel plate coupling the upper and lower plates, the swivel plate extending from side edge to side edge of the upper and lower plates at a location midway between the forward end and rearward end of the upper and lower plates, a central plane located through the tool midway between the upper plate and the lower plate and parallel therewith, a forward opening between the upper and lower plates forwardly of the swivel plate, a rearward opening between the upper and lower plates rearwardly of the swivel plate, the tool being integrally formed of a transparent plastic with limited resilience whereby squeezing together the rearward ends of the upper and lower plates will spread apart the forward ends of the upper and lower plates for receiving sections of fabric, and whereby releasing the rearward ends of the upper and lower plates will resile the forward ends of the upper and lower plates for securing sections of fabric;

interiorly extending enlargements (32) formed in the upper and lower plates adjacent to the forward ends of the upper and lower plates to reduce the height between the upper and lower plates for facilitating the coupling of the tool to two sections of fabric, exteriorly extending enlargements (34) formed in the upper and lower plates adjacent to the rearward ends of the upper and lower plates to facilitate the squeezing of the rearward ends of the upper and lower plates and increasing the distance between the upper and lower plates at the forward ends;

a seam allowance registration mark (38) formed in the interior surface of both the upper and lower plates parallel with the forward end, the seam allowance registration mark being forwardly of the swivel plate, the seam allowance registration mark having a midpoint equally spaced from the side edges;

matching alignment marks (42) in a V-shaped configuration, the matching alignment marks forming an angle common to both the upper and lower plates, the angle having an apex at the midpoint of the seam allowance registration mark; and a pin clearance slot (46) extending through the upper and lower plates from the forward end to a location adjacent to the midpoint of the seam allowance registration mark and the apex of the matching alignment marks.

5. The tool as set forth in claim 4 wherein:

the tool has a length of 2.0 inches, plus or minus 20 percent, a height of 0.375 inches, plus or minus 20 percent, and a width of 0.75 inches, plus or minus 20 percent;

the upper and lower plates have a thickness of 0.125 inches, plus or minus 20 percent;

the swivel plate has a thickness of 0.125 inches, plus or minus 20 percent; and the seam allowance registration mark is 0.25 inches, plus or minus 20 percent, forward from the swivel plate.

* * * * *